US011819867B1

(12) United States Patent
Bonzer

(10) Patent No.: US 11,819,867 B1
(45) Date of Patent: Nov. 21, 2023

(54) DUAL MODE FOAMING SPRAY GUN

(71) Applicant: Bon-Aire Industries, Inc., Boise, ID (US)

(72) Inventor: Robert L. Bonzer, Boise, ID (US)

(73) Assignee: Bon-Aire Industries, Inc., Boise, ID (US)

( * ) Notice: Subject to any disclaimer, the term of this patent is extended or adjusted under 35 U.S.C. 154(b) by 0 days.

(21) Appl. No.: 17/732,325

(22) Filed: Apr. 28, 2022

(51) Int. Cl.
*B05B 7/00* (2006.01)
*B05B 7/04* (2006.01)

(52) U.S. Cl.
CPC ..... *B05B 7/0056* (2013.01); *B05B 7/0408* (2013.01); *B05B 7/0416* (2013.01)

(58) Field of Classification Search
CPC .... B05B 7/0056; B05B 7/0408; B05B 7/0416
USPC ..... 239/310, 312, 315, 318, 443, 444, 446, 239/447, 526
See application file for complete search history.

(56) References Cited

U.S. PATENT DOCUMENTS 3,134,545 A * 5/1964 Armond ..... E03C 1/046 239/443
4,969,603 A * 11/1990 Norman ..... B05B 7/2443 239/335
5,595,345 A * 1/1997 Chura ..... B05B 7/2443 239/312
2005/0161530 A1* 7/2005 Bartsch ..... B05B 7/2443 239/315

* cited by examiner

*Primary Examiner* — Christopher S Kim
(74) *Attorney, Agent, or Firm* — BURDICK PATENTS, P.A.; Sean D. Burdick; Colin L. Honan

(57) ABSTRACT

A dual mode spray gun has a mixing valve with two inlets and two outlets. A handle assembly extending proximally from the valve couples the first inlet to pressurized water and provides means for manually starting and stopping flow. The second inlet draws detergent from a reservoir mounted to the valve. A barrel extending distally from the valve terminates at spray and foam ports connected respectively to the first and second outlets via first and second channels formed through the barrel, the second channel defining an aeration port upstream of the foam port. A mode switch on the mixing valve in a first position allows flow from the first inlet to the spray port, stops flow from the second inlet and stops flow to the foam port, and in a second position stops flow to the spray port and allows flow from the first and second inlets to mix and aerate en route to the foam port.

18 Claims, 5 Drawing Sheets

DUAL MODE FOAMING SPRAY GUN

BACKGROUND OF THE INVENTION

Field of the Invention

The present invention relates generally to spray nozzles that can be connected to a standard garden hose, and more specifically, to a spray gun capable of switching between a spraying operation and a soaping operation.

Description of Related Art

There are many different sprayers, dispensers, and spray guns that can be attached to a typical garden hose for personal or commercial use. A conventional consumer grade combination sprayer and soap dispenser has an inlet that can be attached to a garden hose, a reservoir containing a detergent, a nozzle end, and a trigger. With the water supply from the garden hose turned on, a user can activate the sprayer by squeezing the trigger which opens a valve that directs water flow toward the nozzle. A pressure differential between the water flow and detergent reservoir draws some detergent into the flow to dispense soapy water out of the nozzle.

Different types of nozzles are available for producing a variety of spraying options. For example, a typical sprayer may have a jet stream option, a shower option, a cone option, and even a misting option. It is common in these types of sprayers for the valve control to be designed as a manually operable dial so that a user can easily switch among various settings to obtain a desired spraying option.

Despite their prevalence in the marketplace, consumer grade combination sprayers and soap dispensers are largely ineffective at creating a foamy spray of soapy water that provides desired coverage. That is, the mixture of soap and water exiting the nozzle tends to be a concentrated liquid rather than an airy foam, and causes too much of the detergent to be wasted or dispensed inefficiently. What is needed is a more efficient spray gun and soap dispenser that generates foamy spray.

SUMMARY OF THE INVENTION

The present invention provides a new design for a spray gun that can be connected to a conventional garden hose or other source of pressurized fluid. The spray gun is designed for dual mode operation so that an operator can switch between a spraying operation and a foaming operation.

In a basic embodiment of the invention, the dual mode spray gun has a mixing valve with first and second inlets and first and second outlets. A handle assembly extends from the proximal end of the mixing valve and provides a means for coupling the first inlet to a source of pressurized fluid. Preferably, the coupling means is a threaded nut which can engage a conventional pipe fitting. The handle assembly also includes a means for starting and stopping flow of the pressurized fluid through the first inlet. The mixing valve further includes a means for switching the outflow between the first outlet and the second outlet. In one embodiment, the means for switching the outflow is a manual mode switch mounted to the mixing valve. The mode switch is movable between a first operating position and a second operating position. In the first operating position, the mixing valve allows flow from the first inlet to the first outlet, and stops flow from the second inlet and to the second outlet. In the second position, the mixing valve stops flow to the first outlet, and allows flow from to the second outlet from both the first inlet and the second inlet.

In another embodiment, a dual-channel barrel extends from the distal end of the mixing valve. The barrel terminates at its distal end at first and second openings. A first channel defined through the barrel connects the first opening to the first outlet, and a second channel defined through the barrel connects the second opening to the second outlet. The first opening, linked to the first channel, is preferably configured as a spray port. In a preferred embodiment, the spray port is configured as a nozzle, having a cross-sectional area less than a cross-sectional area of the first channel. The second opening, linked to the second channel, is preferably configured as a foam port. In a preferred embodiment, the foam port is configured with multiple openings each having a cross-sectional area less than a cross-sectional area of the second channel. In another embodiment, the foam port may include an elongated slit formed between a pair of opposing sidewalls that extend into the second channel. In other embodiments, one or more aeration ports are formed through the second channel upstream of the foam port. In one implementation, the aeration port or ports may be formed within a recessed portion of the barrel.

In another embodiment, the spray gun includes a reservoir in fluid communication with the second inlet. Preferably, the second inlet is configured as a tube extending from the mixing valve into the reservoir. In one embodiment, the reservoir is detachable, and the mixing valve includes means for attaching the reservoir.

In another embodiment, the barrel is detachable from the distal end of the mixing valve. For example, the proximal end of the barrel may have a reduced diameter section that frictionally engages an internal surface of the distal end of the mixing valve. In one embodiment, the reduced diameter section of the barrel may further include a sealing ring or o-ring to further engage the internal surface of the distal end of the mixing valve. In another embodiment, the dual mode spray gun may have a retaining clip for securing the barrel to the mixing valve, and the distal end of the mixing valve may be designed with a notched section configured to securely receive and engage the retaining clip. The reduced diameter section of the barrel may also have a corresponding notched section configured to align with the notch on the mixing valve. When properly aligned, the two notched section securely engage the retaining clip.

The first channel may be configured with a protrusion or pipe nipple which engages with the first outlet. Preferably, the protrusion of the first channel includes a sealing ring which creates a fluid tight seal between the first channel and the first outlet. The second outlet may have a similar protrusion which engages the second channel.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE INVENTION

The present invention discloses an innovative dual mode foaming spray gun (hereafter "dual mode spray gun" or "spray gun") that can be used with a conventional hose, such as a garden hose. The dual mode spray gun according to the invention provides a user with multiple cleaning options. The spray gun has two different operational modes, a spraying mode and a foaming mode. A user may quickly and easily alternate between the two operational modes by manually rotating a switch, which in one position diverts water flow through a spray channel and which in another position diverts soap and water through a foam channel. Advantageously, the barrel of the spray gun includes at least one air intake port formed through the foam channel. The air intake port allows air to be introduced into the foam channel and increase aeration, and thus the foaminess, of a mixture of soapy water flowing through the foam channel.

Figures 1, 2:
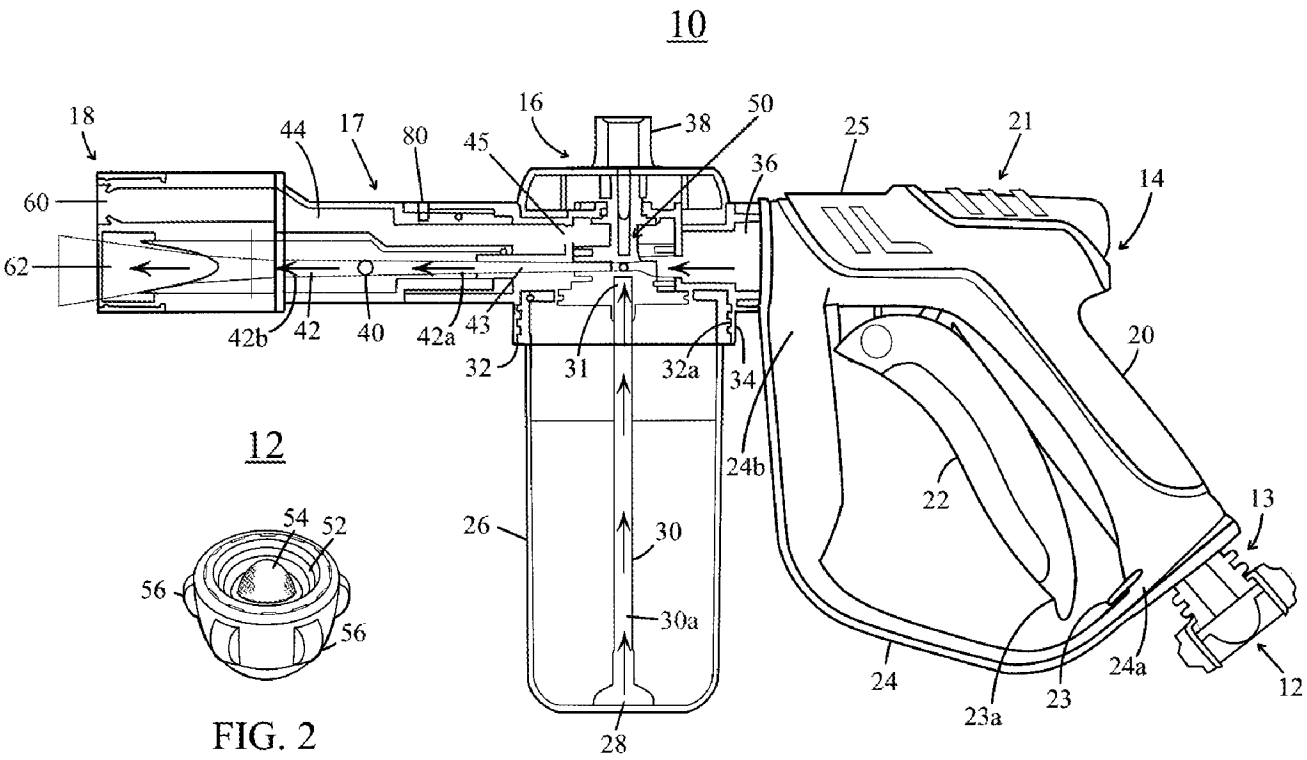
FIG. 1 is a partial cross-sectional side view of one embodiment of a dual mode foaming spray gun according to the present invention.
FIG. 2 is a perspective view of one embodiment of a hose attachment end of the spray gun of FIG. 1.

FIG. 1 illustrates a partial cross-sectional side view of one embodiment of a spray gun according to the present invention. The spray gun 10 includes a handle end 14, a mixing valve 16, a hose attachment end 13, and a nozzle end 18. The mixing valve 16 is configured to engage a removable barrel 17 that extends from the mixing valve 16 in a distal direction to connect the mixing valve 16 to the nozzle end 18. A retaining clip 80 is configured to removably attach the barrel 17 to the mixing valve 16, as more fully explained below with reference to FIGS. 5-7. Preferably, the spray gun 10 is made from an injection-moldable plastic material that is durable when cured. However, other rigid materials, such aluminum or other metals, may be used to make the spray gun 10 using known machining, molding, or casting techniques.

The handle end 14 of the spray gun is formed at the proximal end and provides a hand grip 20 to enable manual operation. The top side of the handle end may include a series of ridges 21. The ridges 21 are configured to provide a mechanical purchase on hand grip 20 for the second hand of a user for better control when the spray gun is in use. Preferably, the ridges 21 are formed in a thin rubber layer that is applied to the exterior of the handle end. The top side of the handle end may be further configured with a notch 25 formed in the rubber layer adjacent to the ridges 21. The rubber layer applied to the exterior of the handle end increases gripability of the handle end when it becomes wet. Alternatively, other materials may be used to provide increased gripping of the handle end when wet.

Figure 11:
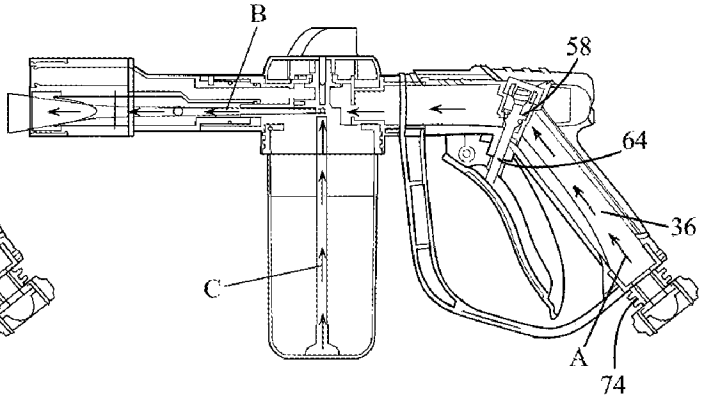
FIG. 11 is a cross-sectional side view of the foam gun of FIG. 1, showing fluid paths when the spray gun is operating with the switch in the second position.

The handle end 14 further includes means for attaching the handle end to a pressurized fluid source, such as a conventional garden hose. In a preferred embodiment, means for attaching the handle end to the pressurized fluid source are provided at the hose attachment end and may include an internally threaded nut 12 that is configured to rotate freely about the hose attachment end 13 and engage the threading of a conventional pipe fitting. As illustrated in FIG. 11, the hose attachment end 13 may include a fluid seal 74 configured to provide a seal between the first inlet 36 and external fluid sources. The first inlet 36 extends through the handle end 14 to the mixing valve 16, and is completely enclosed within the spray gun 10.

FIG. 2 shows a perspective view of the threaded nut 12 isolated from the spray gun 10. The threaded nut 12 has a series of internal female threads 52. The threads 52 are configured for threaded engagement with an external fluid source, such as a garden hose. The threaded nut 12 optionally includes a filter 54 substantially enclosed therein. The filter 54 is preferably made from a durable yet flexible material, such as aluminum or other metal materials, however durable plastics materials may also be used. Formed around the exterior of the threaded nut 12 is a series of gripping ridges 56. The gripping ridges 56 are configured to provide an easy gripping surface for an operator and allow for quick and easy attachment of the spray gun to an external hose.

The handle end 14 further includes a means for starting and stopping the flow of pressurized fluid through the first inlet 36. In a preferred embodiment, the means for starting and stopping the flow of fluid is a trigger 22 that is operably connected to a flow control valve 58 positioned in the first inlet 36. The flow control valve 58 may be configured as a gate valve or a ball valve to control the flow of fluid introduced into the first inlet 36. Movement of the trigger varies the width of an internal flow port between a closed position and a fully open position. When an operator squeezes the trigger, the flow control valve is actuated to an open position and fluid from an external source is drawn into the first inlet 36 and allowed to flow freely past the flow control valve 58. When an operator releases the trigger, and the flow control valve returns to a closed position and fluid flow through the first inlet 36 ceases. For ease of continuous operation, the spray gun may include a trigger locking ring 23. The locking ring 23 is configured to lock the trigger and thus lock the flow control valve in an intermediate position between closed and fully open, or in the fully open position. Preferably, the trigger 22 has a locking rim 23*a* formed on its lower end and configured to receive the locking ring 23 and prevent slippage.

In one embodiment, the handle end 14 may further include a finger guard 24. The finger guard 24 may be formed as an integral component of the handle end 14. In the example shown, the finger guard 24 may extend in an are from the hose attachment end 13 at a location 24*a* to a location 24*b* at the proximal end of the mixing valve 16. The finger guard 24 shields an operator's hand from accidental impact, and adds strength and stability to the handle end 14.

The first inlet 36 continues through the handle end and into the mixing valve 16, which in one embodiment may be integrally connected to the handle end 14. The mixing valve 16 includes a means for switching outflow from the mixing valve to either a first outlet 45 or to a second outlet 43. In a preferred embodiment, the means for switching the outflow is configured as an external mode switch 38 operably connected to a diverter valve assembly 50. The switch 38 is configured to be operable between at least two positions, and may be manually operable. In the exemplary illustrations of FIGS. 8-11, mode switch 38 may be set to a first or spray position 54 (see FIG. 9) and may alternatively be set to a second or foam position 56 (see FIG. 8). The positions of the mode switch 38 shown in FIGS. 8-11 are for illustration purposes only, i.e., in another embodiment, the rear positioning of the mode switch 38 can be operable as the foam position and the forward positioning can be operable as the spray position. When the mode switch 38 is in the spray position 54, the first inlet 36 is maintained fluid communication with the first outlet 45, and the second inlet 30 and second outlet 43 are shut off. The first outlet 45 connects to a first channel 44 that extends through the barrel 17 to the nozzle end 18, where it terminates at a first opening 60. In a preferred embodiment, the first opening 60 is configured as a spray port, which may be further configured as a nozzle.

Alternatively, when the switch 38 is in the foam position 56, the first inlet 36 and second inlet 30 are in fluid communication with the second outlet and the first outlet 45 is shut off. The second outlet 43 is connected to a second channel 42 that extends through the barrel 17 to the nozzle end 18, where it terminates at a second opening 62. In a preferred embodiment, the second opening 62 is configured as a foam port, which may define multiple openings.

Figure 9:
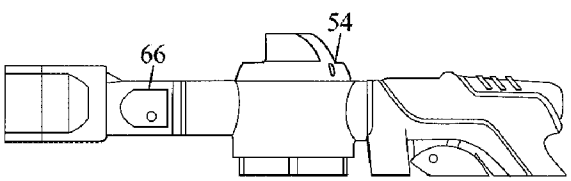
FIG. 9 is a partial side view of the spray gun of FIG. 1, showing the mode switch in a second operating position.
Figure 10:
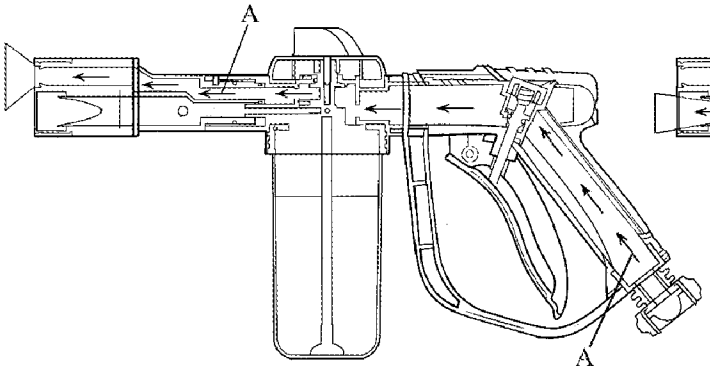
FIG. 10 is a cross-sectional side view of the foam gun of FIG. 1, showing a flow path when the spray gun is operating with the switch in the first position.

FIGS. 9 and 10 show the mode switch 38 set to the spray position. In this position, the fluid will follow the path of the arrows A in FIG. 10, from the first inlet 36 to the first outlet 45 and into the first channel 44 to be expelled out the first opening 60. Also with the mode switch in the first position, the mixing valve 16 creates a fluid seal between the junction of the first inlet 36 and the first outlet 45 to ensure that no fluid escapes or leaks elsewhere. Also in the spray position, the mixing valve 16 seals off the second channel 42 to prevent fluid flow therethrough.

Figure 8:
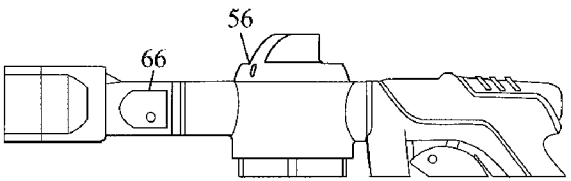
FIG. 8 is a partial side view of the spray gun of FIG. 1, showing a mode switch in a first operating position.

FIGS. 8 and 11 show the mode switch 38 set to the foam position. In this position, fluid will follow the path of the arrows from A to B in FIG. 11, from the first inlet 36 to the second outlet 43 and into the second channel 42 to be expelled out the second opening 62. As fluid passes through the mixing valve 16 and into the second outlet 43, a second fluid, such as a solution of detergent contained in a tank or reservoir 26 can be drawn along arrows C and mixed with the fluid from the first inlet 36. This action is described in more detail below. With the mode switch 38 in the foam position, the mixing valve 16 creates a fluid seal between the junction of the first inlet 36 and the second outlet 43 to ensure that no fluid escapes or leaks elsewhere. Also in the foam position, the mixing valve 16 further seals off the first channel 44 to prevent fluid flow therethrough.

The mixing valve 16 can further have a reservoir attachment 34 configured to removably attach an external tank or reservoir 26. The reservoir 26 is configured to house a solution, such as a liquid soap or other cleaning solution. In a preferred embodiment, the reservoir 26 comprises a generally cylindrical container capable of retaining at least eight ounces of liquid. Alternatively, the reservoir 26 may be of any other geometric shape or size, and may be attached or detached from the spray gun 10, without departing from the scope of the invention.

In one embodiment, the reservoir attachment 34 has internal female threads 32 configured for threaded engagement with male threads 32*a* of the reservoir 26. The reservoir 26 may optionally include a sealing ring, such as a rubber o-ring, attached to the top thereof to ensure that a tight seal between the mixing valve 16 and the reservoir 26 is maintained. The threaded engagement between the female threads 32 of the reservoir attachment and the male threads 32*a* of the reservoir creates a seal such that no solution housed in the reservoir can leak out. In alternate embodiments, the reservoir 26 may be removably attached to the mixing valve by other means. For example, the reservoir 26 may have a friction fit engagement with the reservoir attachment 34, the reservoir attachment 34 may have a series of snapping locks that can receive the reservoir 26, or any other means of removably sealingly attaching the reservoir 26 to the spray gun 10 may be used. Skilled artisans will recognize there are a variety of different means in which the reservoir may be removably attached to the mixing valve without departing from the scope of the invention.

The mixing valve 16 also has a second inlet 30. In a preferred embodiment, the second inlet 30 is configured as a tube extending from the mixing valve 16 into the reservoir 26. In the one embodiment, the second inlet 30 may be formed as a rigid but somewhat flexible tube, and may be made, for example, from a plastic or rubber material. The tube must be rigid enough such that it will not float or move substantially while submerged in a solution of the reservoir but also flexible enough to withstand creasing or fracture during installation and use. The second inlet 30 is preferably positioned substantially centrally with respect to the reservoir attachment 34. In one embodiment, the second inlet 30 may be formed as an integral extension of the mixing valve 16. Alternatively, the second inlet 30 may be removably attached to the mixing valve 16. In this embodiment, the removability of the second inlet 30 allows a user to replace or repair a damaged tube or clean the inlet 30 if it has become clogged with debris. In other embodiments, the second inlet 30 may be threadingly engaged with the mixing valve 16, may be friction-fit to the mixing valve 16, or may be secured to the mixing valve 16 by a clip or clamping mechanism. Still other attachment mechanisms may be used without departing from the scope of the invention.

The second inlet 30 may also be referred to herein as the tube 30*a*. In a preferred embodiment, with the spray gun 10 in a preferred operating orientation as shown in FIG. 1, the tube 30*a* extends in a downward direction away from the mixing valve 16. The tube 30*a* may have a preferred length that allows the tube head 28 to be in close contact with a bottom inner surface of the reservoir 26 to ensure that the tube 30*a* is optimally located to draw from the reservoir 26 substantially all of its fluid content. In one embodiment, the tube inlet may include a plurality of spaced apart ridges around its perimeter that are designed to contact inner bottom surface of reservoir to provide pathways for fluid to flow into the tube between adjacent ridges. The second inlet 30 has a terminal end 31 that can be connected into in fluid communication with the second outlet 43. With the mode switch 38 in the foam position, as pressurized fluid from the first inlet 36 flows through the mixing valve 16 and into the second outlet 43, a Venturi effect is created in accordance with well-known scientific principles which draws solution out of the reservoir 26 and into the second inlet 30 to be mixed with the pressurized fluid at the junction of the terminal end 31 and the second outlet 43. In operation, when the switch 38 is turned to the foam position 56, the two fluids will form a mixed flow through the second channel 42.

Figure 3:
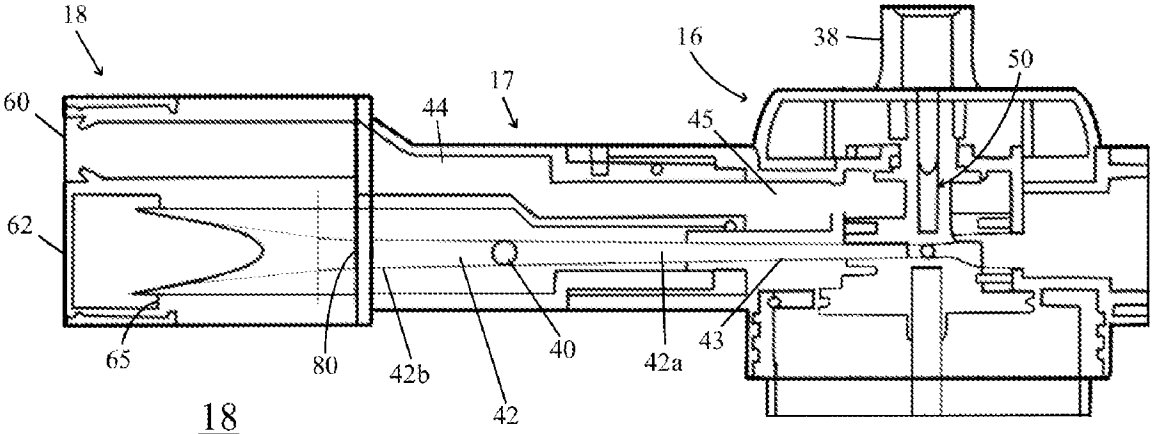
FIG. 3 is a magnified cross-sectional side view of the mixing valve, barrel, and nozzle end of the spray gun of FIG. 1.

FIG. 3 illustrates a magnified cross-sectional side view of the barrel 17 that connects the nozzle end 18 of the spray gun 10 to the mixing valve 16. The barrel 17 is preferably configured to removably attach the nozzle end 18 to the mixing valve 16. The barrel 17 defines a first channel 44 formed through the interior of the barrel 17. The first channel 44 engages the first outlet 45 of the mixing valve 16. The first channel 44 terminates at a first opening 60 in the nozzle end 18. The barrel 17 also defines a second channel 42 that engages the second outlet 43 of the mixing valve 16. The second channel 42 similarly terminates at a second opening 62 in the nozzle end 18. Each channel creates a fluid seal with its corresponding outlet to prevent fluid leakage through the channel-to-outlet junction. The diameter of the first channel remains substantially consistent throughout the length of the channel. In contrast, the diameter of the second channel preferably increases from the proximal end 42*a* as it approaches the distal end 42*b*. The proximal end 42*a* of the second channel 42 is narrower where the first fluid (e.g. water) from the first inlet mixes with the second fluid (i.e. a liquid soap). As the solution and fluid mix, the combined flow continues through the second channel 42 toward the distal end 42*b* which has an increasing diameter to allow for the formation of suds.

In one embodiment, the increasing diameter of the second channel 42 and the composition of the second fluid are formed to promote turbulent flow as the mixed fluid reaches the proximal end 42*b* upstream of the second opening 62. Turbulent flow in a pipe of diameter D is known to occur for a Reynolds number R of approximately 2300, where R=VDp/u and where V is the average velocity of the fluid, p is the liquid density, and u is the absolute viscosity. The diameter D of the second channel 42 is minimum at location 47 within the mixing valve 16, where flows from the first and second inlets combine. The minimum diameter acts as a nozzle to increase the average velocity V of the combined flow. As the diameter D of the second channel 42 increases as it approaches the second opening 62, the combined flow will transition from laminar to turbulent under the right conditions of V, D, p and u. Because turbulent flow is characterized by chaotic changes in flow and pressure, its occurrence within the second channel promotes a homogeneous combination of the two liquids to facilitate soapy spray.

The barrel 17 further includes at least one air intake or aeration port 40 defined in the distal end 42*b* of the second channel 42. The air intake port 40 is configured to allow air to be introduced into the mixture of fluids traveling through the second channel 42. The introduction of air into the second channel at this location increases aeration of the mixture and thus increases the foaminess of the mixture, especially when air is introduced into turbulent flow. The desired result of this configuration is a maximization in the production of foaming suds to be expelled from the second opening 62. Further, the increase in aeration of the mixture in the second channel can minimize waste of the cleaning solution that may result from an inefficient mixing of the soap solution with the first fluid.

In another embodiment, the second channel 42 may include a mesh screen or filter 80 positioned within the channel. Preferably, the filter is positioned some distance inward from the second opening 62 and between the distal end 42*b* within the second channel 42. The plurality of holes that make up the filter 80 can aid in the creation of foaming suds as the mixed solution is forced through the filter 80 and expelled from the second opening 62.

Figure 4:
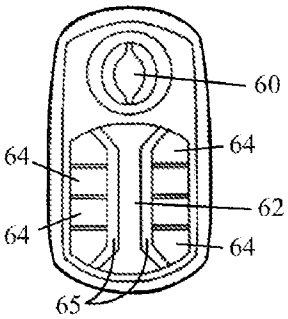
FIG. 4 is a front end view of the spray gun of FIG. 1.

FIG. 4 shows a front end view of the nozzle end 18 of a spray gun 10. The nozzle end has at least two openings formed therein. The first opening 60 (or spray port) is in fluid communication with the first channel 44. The first opening 60 is preferably formed as a nozzle, for example, in the narrowed slit configuration shown, to increase the velocity of spray exiting the channel. Generally, the nozzle of the first opening 60 can be formed in any manner whereby its cross-sectional area is less than the cross-sectional area of the first channel 44 immediately upstream of the first opening.

The nozzle end 18 has a second opening 62 or foam port. The second opening 62 is in fluid communication with the second channel 42. The second opening 62 may be configured as a plurality of openings. In one embodiment, one of the plurality of openings may be formed an elongated slit between two opposing sidewalls 65, and the remaining openings 64 may be formed along opposite sides of the sidewalls 65. The opposing walls 65 may be integrally formed in the nozzle end and extend into the second channel 42. To promote expansion of foamy fluid exiting the spray gun 10, the second opening 62 may have a cross-sectional area that is greater than the cross-sectional area of the second channel 42. The openings 64 may be formed with similar areas to promote the formation of similarly sized air bubbles.

Figure 5:
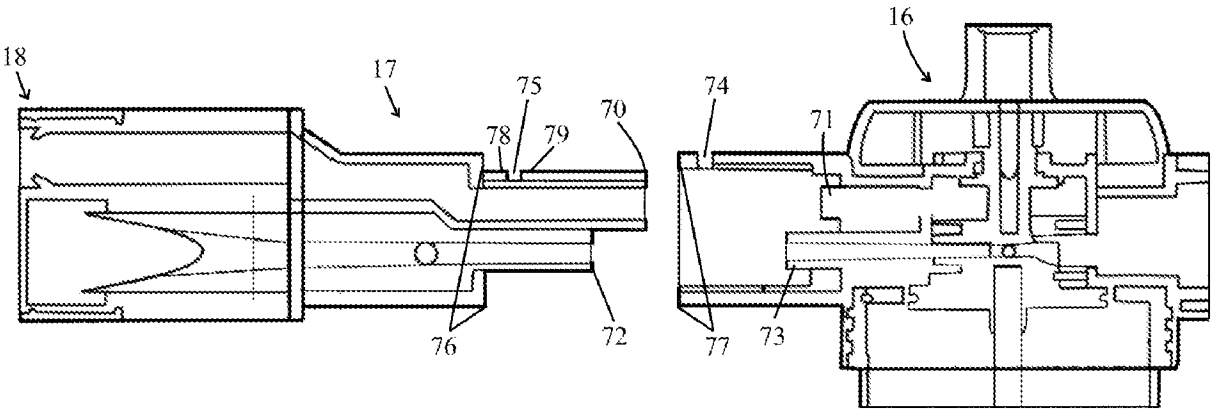
FIG. 5 is an exploded cross-sectional view of the spray gun of FIG. 1, showing the mixing valve separated from the barrel.

FIG. 5 shows an exploded cross-sectional view of the mixing valve 16 separated from the barrel 17. In this embodiment, the barrel 17 is removable from the mixing valve 16. When connected to the mixing valve 16, the barrel 17 extends in a distal direction away from the mixing valve 16 and places the nozzle end 18 in fluid communication with the mixing valve. The distal end of the mixing valve 16 is configured to engage the proximal end of the barrel 17 and create a tight fluid seal. Engagement between the barrel and the mixing valve body may be accomplished through a friction fit engagement. Other means of connecting the barrel to the mixing valve body may be used without departing from the scope of the invention. For instance, engagement may be achieved by using a series of locking clips or snaps to secure the two components. As shown in FIG. 5, the barrel 17 at its proximal end may have an outer diameter that approximately equals the inner diameter of the distal end of the mixing valve. At an intermediate location 76 along the barrel 17, its outer diameter is made greater than the inner diameter of the distal end of the mixing valve 16. The barrel 17 may thus be inserted into the mixing valve 16 until the outer diameter at location 76 abuts the ends 77 of the distal end of the mixing valve.

The mixing valve 16 may further include a notch 74 for securing the valve 16 to the barrel 17. The notch 74 preferably extends substantially around the diameter of the distal end of the mixing valve. The barrel 17 may have a corresponding notch 75 formed in the insertion part of its outer surface, as shown. The notch 75 is formed between ridges 78, 79. The notch 74 on the valve 16 is configured to align with the notch 75 on the barrel when the first and second channels 44, 42 are aligned with the first and second outlets 45, 43 respectively. When notches 74 and 75 are aligned, a retaining clip 82 may be installed into the two notches to lock the mixing valve 16 to the barrel 17. As shown in FIG. 7, the retaining clip 82 may be generally formed as a circular arc and include an inward protrusion 84 centrally located at the apex of the arc. The retaining clip 82 may further include a pair of inward protrusions 86 formed on opposing ends of the arc. When the barrel 17 is properly inserted within and aligned to the mixing valve 16, the retaining clip 82 can lock the barrel to the valve by inserting protrusion 84 into notch 74 and between ridges 78, 79 and by pushing the clip downward through notches 74 and 75. With the retaining clip 82 so installed, the barrel and valve are prevented from being pulled apart by interference of protrusions 86 with a baffle 92 (FIG. 6).

Figure 6:
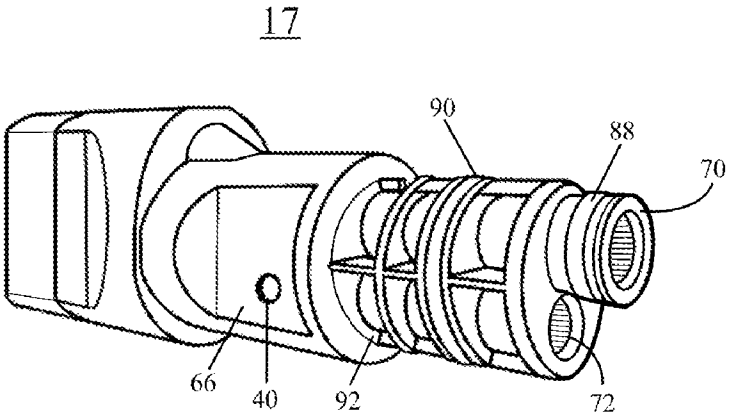
FIG. 6 is a proximal end perspective view of the barrel of the spray gun of FIG. 1.
Figure 7:
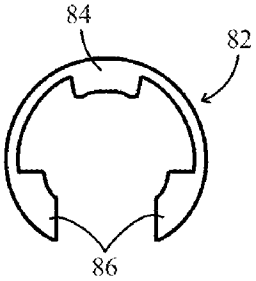
FIG. 7 is a front view of a retaining clip for use with the spray gun of FIG. 1.

FIG. 6 illustrates a proximal end perspective view of one embodiment of a barrel 17, shown isolated and removed from the spray gun 10. This view shows a cylindrical protrusion 70 formed on the proximal end of the barrel 17. The protrusion 70 partially encloses the first channel 44 and is configured to engage the mixing valve 16 and couple to the first outlet 45. An optional o-ring 88 may be installed around the protrusion 70 to further seal the engagement between the protrusion 70 and the aperture 71 when the barrel and mixing valve are fully engaged. Another optional o-ring 90 may be installed on the reduced diameter section of the barrel 17 at location 76. The o-ring 90 creates a reliable seal between the barrel 17 and the primal end of the mixing valve 16 when the barrel has been inserted therein.

Referring again to FIG. 5, the second outlet 43 of the mixing valve 16 terminates at an outlet protrusion 73. The second channel 42 of the barrel 17 has a channel aperture 72 that corresponds to the outlet protrusion 73. The channel aperture 72 is configured to tightly engage the outlet protrusion 73 when the barrel 17 is properly aligned in the distal end of the mixing valve 16. Preferably, the outlet protrusion 73 frictionally engages the channel aperture 72 and creates a fluid seal between the two components. In an alternate embodiment, the outlet protrusion 73 can include an o-ring (not depicted) to further seal the engagement in the channel aperture 72. The fluid seal created between the channel aperture 72 and the outlet protrusion 73 results in unobstructed fluid flow from the second outlet 43 through the second channel 42 to the second opening 62.

FIG. 6 also shows a recess 66 formed on one side of the barrel 17 at an intermediate location between its proximal and distal ends. Another similar recess 66 may be formed symmetrically on the opposite side of the barrel 17. One or more of the aeration ports 40 may be formed through one or both recessed surfaces to open a pathway for ambient air to combine with mixed fluid flowing through the second channel 42. One or both recesses 66 may be formed with a flat surface for engagement of a tool such as an end wrench to assist with installation and removal of the barrel 17 to and from the mixing valve 16.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A dual mode spray gun comprising:

a mixing valve having a first inlet, a second inlet, a first outlet, a second outlet, and a means for switching an outflow to the first outlet or to the second outlet:

a handle extending from a proximal end of the valve, the handle including a means for coupling the first inlet to a pressurized fluid and a means for starting and stopping a pressurized fluid flow; and a barrel extending from a distal end of the mixing valve and having a scaling ring configured to sealingly engage an internal surface of the distal end of the mixing valve, the barrel defining a first channel coupling the first outlet to a spray port, a second channel coupling the second outlet to a foam port, and at least one aeration port formed through the second channel upstream of the foam port.

2. The dual mode spray gun of claim 1, wherein the barrel defines a plurality of aeration ports in the second channel.

3. The dual mode spray gun of claim 1, wherein the mixing valve further comprises a means for attaching a detachable reservoir.

4. The dual mode spray gun of claim 3, wherein the second inlet is in fluid communication with the detachable reservoir.

5. The dual mode spray gun of claim 3, wherein the second inlet comprises a tube extending from the mixing valve into the detachable reservoir.

6. The dual mode of claim 1, wherein the spray port has a cross-sectional area less than a cross-sectional area of the first channel.

7. The dual mode spray gun of claim 1, wherein the foam port comprises multiple openings each having a cross-sectional area less than a cross-sectional area of the second channel.

8. The dual mode spray gun of claim 7, wherein the multiple openings include an elongated slit formed between a pair of opposing sidewalls that extend into the second channel.

9. The dual mode spray gun of claim 1, wherein the barrel is removably attached to the distal end of the mixing valve.

10. The dual mode spray gun of claim 9, wherein the mixing valve further comprises a retaining clip configured to secure the barrel to the distal end of the mixing valve.

11. The dual mode spray gun of claim 10, wherein the distal end of the mixing valve has a first notched section formed thereon and configured to engage the retaining clip.

12. The dual mode spray gun of claim 11, wherein a proximal end of the barrel has a second notched section that corresponds to the first notched section, wherein the first and second notched sections are configured to align and engage the retaining clip.

13. The dual mode spray gun of claim 1, wherein the first channel further comprises a protrusion configured to securely engage the first outlet.

14. The dual mode spray gun of claim 13, wherein the protrusion further comprises a sealing ring configured to create a fluid tight seal between the first channel and the first outlet.

15. The dual mode spray gun of claim 1, wherein the second outlet further comprises a protrusion configured to securely engage the second channel.

16. The dual mode spray gun of claim 1, wherein the at least one aeration port is formed within a recessed portion of the barrel.

17. The spray gun of claim 1, wherein the outflow switching means allows an operator to select a first operating mode or a second operating mode:

whereby the first operating mode maintains the first inlet in fluid communication with the first outlet, stops the flow from the second inlet, and stops the flow to the second outlet; and wherein the second operating mode maintains the first inlet and the second inlet in fluid communication with the second outlet, and stops the flow to the first outlet.

18. A dual mode spray gun comprising:

a mixing valve having a first inlet, a second inlet, a first outlet, a second outlet, and a means for switching an outflow to the first outlet or to the second outlet;

a handle extending from a proximal end of the valve, the handle including a means for coupling the first inlet to a pressurized fluid and a means for starting and stopping a flow of the pressurized fluid flow; and a barrel defining a first channel coupling the first outlet to a spray port, a second channel coupling the second outlet to a foam port, and at least one aeration port formed through the second channel upstream of the foam port, wherein a proximal end of the barrel has a reduced diameter section configured to frictionally engage an internal surface of a distal end of the mixing valve.

* * * * *